US006698317B1

(12) United States Patent
Machovsky

(10) Patent No.: US 6,698,317 B1
(45) Date of Patent: Mar. 2, 2004

(54) MULTI-PURPOSE PLUMBING TOOL

(76) Inventor: Andrew J. Machovsky, 1178 E. Orchid La., Gilbert, AZ (US) 85296

( * ) Notice: Subject to any disclaimer, the term of this patent is extended or adjusted under 35 U.S.C. 154(b) by 0 days.

(21) Appl. No.: 09/645,845

(22) Filed: Aug. 24, 2000

(51) Int. Cl.[7] ..... B25B 13/02
(52) U.S. Cl. ..... 81/124.2; 81/177.5
(58) Field of Search ..... 81/124.2, 124.4, 81/177.5

(56) References Cited

U.S. PATENT DOCUMENTS 3,086,414 A * 4/1963 Nardi ..... 81/124.2 X
3,738,768 A * 6/1973 Kuhn ..... 81/177.5 X
4,882,958 A * 11/1989 McNeeley ..... 81/124.4
5,440,957 A * 8/1995 Rogers ..... 81/124.4
5,996,447 A * 12/1999 Bayouth ..... 81/124.2 X

* cited by examiner

*Primary Examiner*—James G. Smith
(74) *Attorney, Agent, or Firm*—John D. Lister

(57) ABSTRACT

A multi-purpose plumbing tool includes first and second tubular sockets. A first end portion of each of the tubular sockets has four notches therein, extending inward from a first end of the tubular socket and spaced from each other on 90° centers, for receiving complementary parts to be rotated and tightened or loosened by one of the sockets. Preferably, the second end portion of the second tubular socket can be removably mounted on the first end portion of the first tubular socket to rotate with the first tubular socket. The second end portion of the first tubular socket has a means for rotating the first tubular socket to tighten or loosen complementary parts received in the notches of the first tubular socket or received in the notches of the second tubular socket when the second tubular socket is mounted on the first end portion of the first tubular socket.

5 Claims, 3 Drawing Sheets

FIG. 1
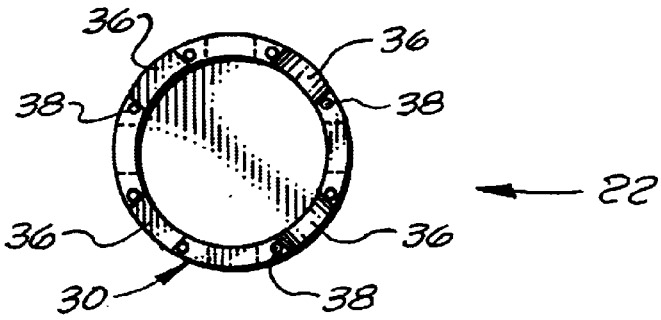
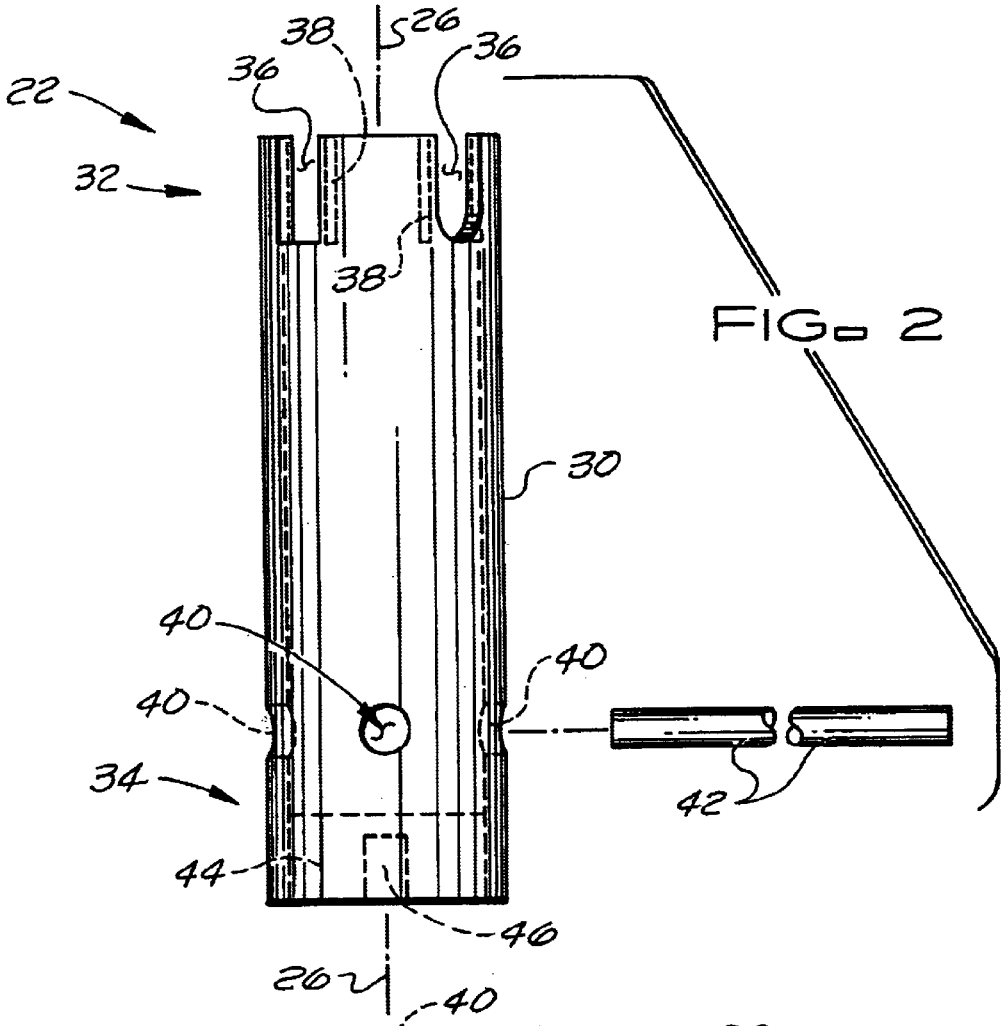
FIG. 2
FIG. 3
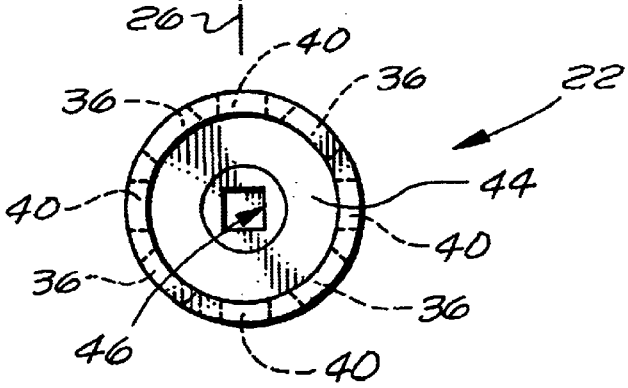

MULTI-PURPOSE PLUMBING TOOL

BACKGROUND OF THE INVENTION

The present invention relates to a multi-purpose plumbing tool and, in particular, to a multi-purpose plumbing tool for tightening or loosening plumbing parts, especially parts used in drain-waste-vent systems, such as but not limited to, plugs for nominal 1½ inch and 2 inch plastic pipes, faucet mounting nuts with flanges (hereinafter "flanged faucet mounting nuts"), bathtub drain pieces, flanged drain test plugs, sink basket strainer pieces, and similar pieces or parts.

Frequently, when clearing clogs in drain-waste-vent systems, it becomes necessary to remove a plug present in the drain-waste-vent system from the drain-waste-vent system to insert a drain snake or auger. The piping of the drain-waste-vent system is normally located within an interior wall of the building and a hole must be provided in the wall to gain access to the plug for its removal so that appropriate clog clearing tool can be introduced into the system. These plugs typically have square heads used to loosen or tighten the plugs and are only about 2 to about 2½ inches across. Accordingly, the size of the hole required in a wall to remove and replace a plug would not have to be very large to permit the removal and replacement of the plug. However, the loosening and tightening of these plugs, as currently practiced, poses a problem. Under current practices, the heads of the plugs are typically gripped with channel lock pliers or similar tools which require an opening much larger than the cross section of the plug. Thus, if the access hole in the wall is approximately the size of the plug in cross section, the portion of the wall adjacent the access hole, typically drywall, becomes damaged by the channel lock pliers or similar tools when the plug is removed and replaced.

Another problem associated with drain-waste-vent systems arises in the installation or removal of bathtub drain pieces. These pieces are typically about two inches long with spokes at the bottom. Currently, to tighten these bathtub drain pieces in place or to loosen these bathtub drain pieces for removal, a plumber will use two screwdrivers which are inserted down into the bathtub drain piece and moved to cause to bathtub drain piece to rotate. The use of the two separate tools to tighten or loosen these bathtub drain pieces can be quite awkward, especially, if threads of the bathtub drain piece and the drain tailpiece are corroded together.

In addition to the need for a tool to alleviate the problems associated with the installation and removal of plugs and bathtub drain pieces discussed above, there has continued to be a need for a tool to facilitate the tightening and loosening of flanged faucet mounting nuts, flanged drain test plugs, sink basket strainers, and similar pieces or parts.

SUMMARY OF THE INVENTION

The multi-purpose plumbing tool of the present invention solves the problems currently encountered in carrying out the above plumbing procedures by providing a multi-purpose plumbing tool that: enables plugs to be easily rotated and unthreaded from or threaded into plumbing fittings within a wall though an opening in the drywall that only needs to be large enough to accommodate the plug; enables flanged faucet mounting nuts to be easily rotated and threaded onto or unthreaded from faucet stems; bathtub drain pieces to be easily rotated and threaded into or unthreaded from drain assemblies; flanged drain test plugs to be easily rotated and threaded into or unthreaded from bathtub drain pieces or parts; and sink strainer pieces to be easily held stationary while a strainer nut is rotated and threaded onto or unthreaded from the sinke strainer.

Preferably, the multi-purpose plumbing tool of the present invention includes first and second tubular sockets which can be extended through holes in walls to reach the heads of plugs within the walls, accommodate faucet stems when threading faucet mounting nuts onto or off of faucet stems, and extended down into bathtub drain or up to basket strainer pieces to thread such parts into or unthread such parts from drain assemblies. A first end portion of each of the tubular sockets has four notches therein, extending inward from a first end of the tubular socket and spaced from each other on 90° centers, for receiving a complementary part to be tightened or loosened by one of the sockets, such as the square head of a pipe fitting plug, the flanges on a faucet mounting nut or test plug, or the radially extending spokes of a bathtub drain or basket strainer piece. As used herein the term "complementary part" includes pieces or parts which have heads or flanges that fit into or are received within the notches of the socket so that the piece or part can be rotated and tightened or loosened by threading or unthreading the piece or part from another piece or part, such as but not limited to the four corners of a square head of a plug which are received within the four notches; a flange or pairs of flanges which are received within two diametrically opposed notches of the four notches; and two flanges or pairs of flanges or spokes oriented at right angles to each other that are each received within two diametrically opposed notches of four notches.

The second tubular socket can accommodate and is used to rotate and tighten or loosen larger sized parts or pieces than the first tubular socket. Preferably, the second end portion of the second tubular socket can be removably mounted on the first end portion of the first tubular socket to rotate with the first tubular socket. The second end portion of the first tubular socket has a hole extending through its wall for receiving a handle and/or a hole in an end wall of the socket for receiving a conventional socket drive and/or a similar means for rotating the first tubular socket to tighten or loosen a complementary part received in the notches of the first tubular socket or received in the notches of the second tubular socket when the second tubular socket is mounted on the first end portion of the first tubular socket.

BRIEF DESCRIPTION OF THE DRAWINGS

FIG. 1 is a top view of the first tubular socket;

FIG. 2 is a side view of the first tubular socket;

FIG. 3 is a bottom view of the first tubular socket;

DESCRIPTION OF THE PREFERRED EMBODIMENTS

Figure 4:
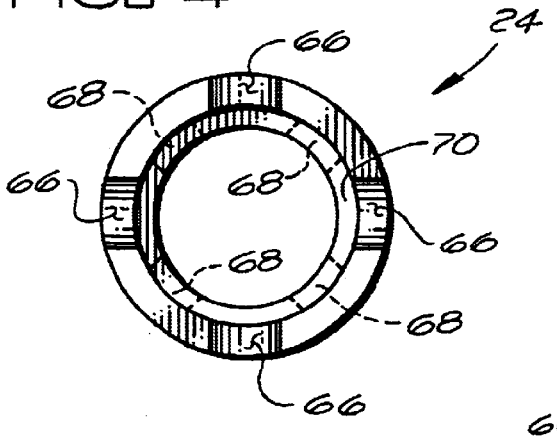
FIG. 4 is a top view of the second tubular socket.
Figure 5:
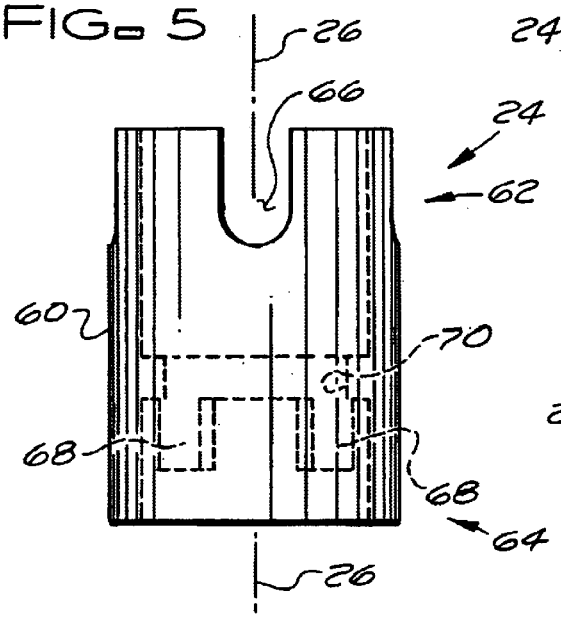
FIG. 5 is a side view of the second tubular socket.
Figure 6:
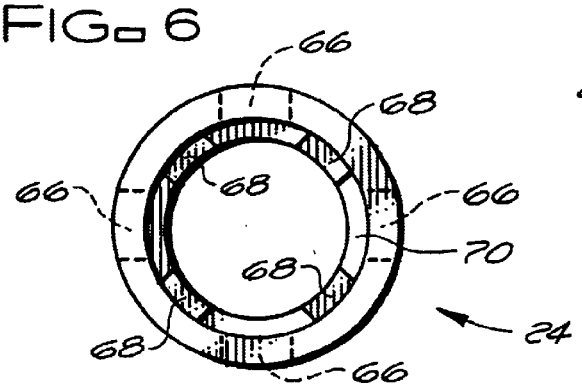
FIG. 6 is a bottom view of the second tubular socket.
Figure 7:
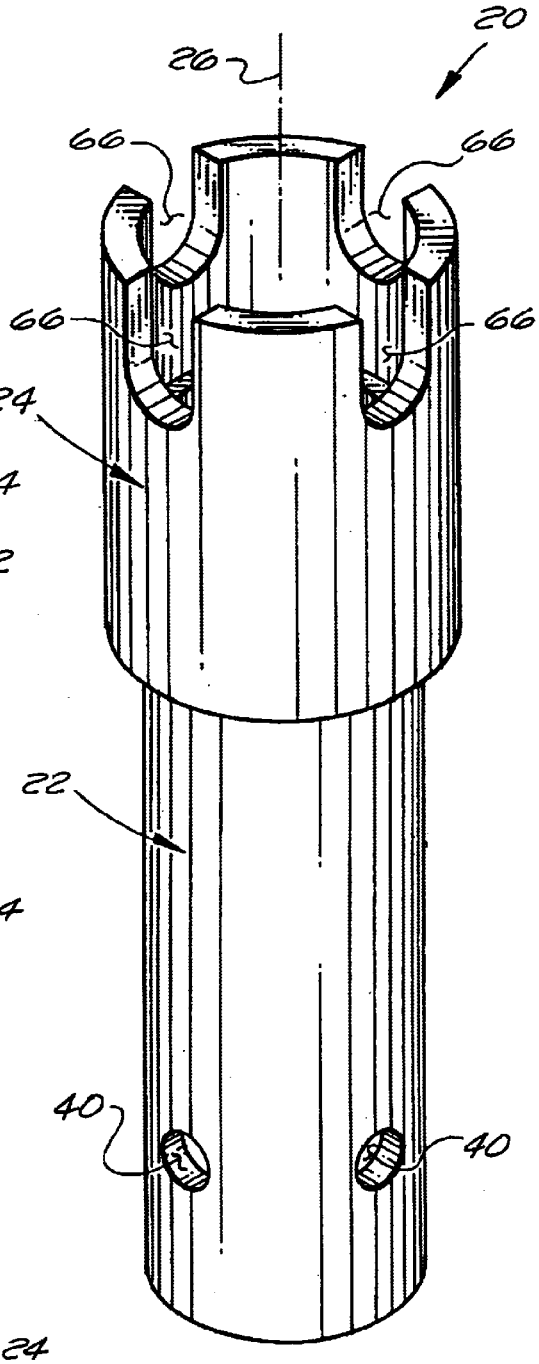
FIG. 7 is a perspective view of the second tubular socket mounted on the first tubular socket along with a handle.
Figure 8A:
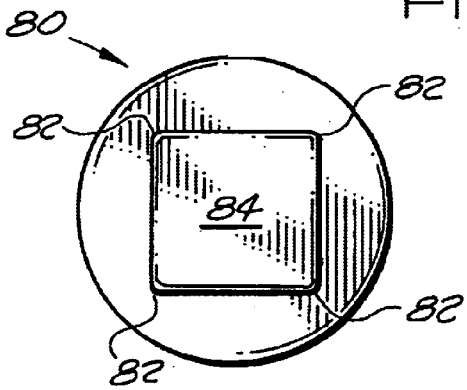
FIGS. 8A and 8B are end and side views of a conventional externally threaded pipe fitting plug.
Figure 9A:
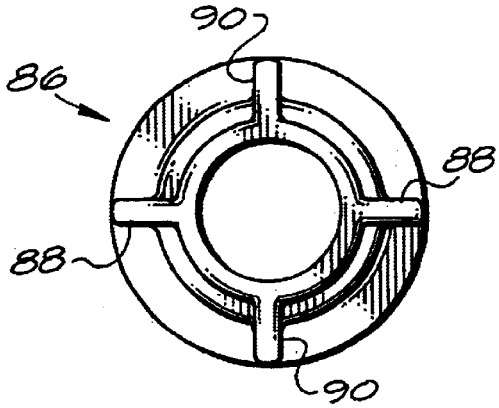
FIGS. 9A and 9B end and side views of a typical internally threaded flanged faucet nut.
Figure 8B:
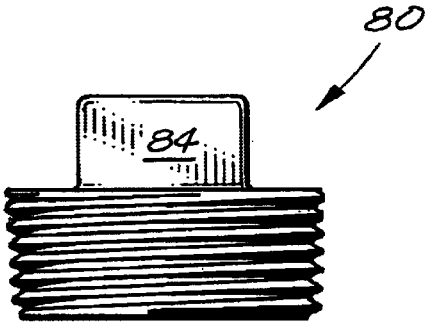
Figure 9B:
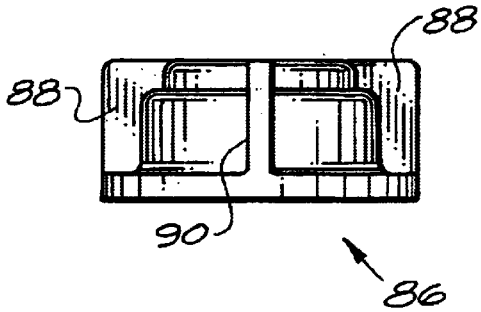
Figure 10:
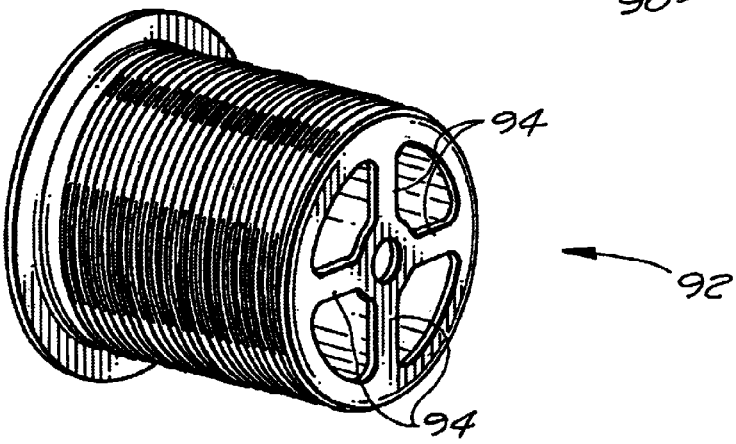
FIG. 10 is a perspective view of an externally threaded bathtub drain piece.

Preferably, the multi-purpose plumbing tool 20 of the present invention includes a first tubular socket 22, as shown in FIGS. 1–3 and a second tubular socket 24, as shown in FIGS. 4–6, which is removably mounted on the first tubular socket 22 as shown in FIG. 7. The multi-purpose plumbing tool 20 has a longitudinal axis 26. Typically, the first tubular socket 22 is used to rotate and tighten or loosen (thread one part into or onto another part or unthread one part from another part) parts for a first nominal pipe size or sizes (e.g. 1¼ or 1½ inch nominal inside diameter sizes that are standard in the industry) and the second tubular socket 24 is used to rotate and tighten or loosen parts of a larger nominal pipe size or sizes (e.g. 2 inch nominal inside diameter size that is standard in the industry). For example, the first tubular socket may used to tighten and loosen parts for nominal 1½ inch diameter rigid plastic pipe, such as the standard rigid plastic polyvinyl chloride (PVC) or acrylonitrile-butadiene-styrene (ABS) pipe currently used in drain-waste-vent systems, and the second tubular socket may used to tighten and loosen parts for nominal 2 inch diameter rigid plastic pipe, such as the standard rigid plastic polyvinyl chloride (PVC) or acrylonitrile-butadiene-styrene (ABS) pipe currently used in conventional drain-waste-vent systems.

As shown in FIGS. 1–3, the first tubular socket 22 has a tubular wall 30 with a first end portion 32 and a second end portion 34. The tubular wall 30 at the first end portion 32 has four notches 36 therein, which extend inward from the first end of the first tubular socket 22, parallel to the longitudinal axis 26, and are spaced from each other on 90° centers, for receiving a complementary part to be tightened or loosened. As shown in FIG. 2, the cut outs forming the notches 36 can be squared off at their base (the notch on the left side of the figure) or the notches can have a radius at their base (the notch on the right side of the figure). Typically, the notches 36 are squared off at their base when the first tubular socket is made of a metal e.g. steel and the notches have a radius at their base when the first tubular socket is made of plastic, e.g. a C polyvinyl chloride. When the first tubular socket 22 is made of plastic, the portions of the socket sidewall 30 intermediate the notches 36 can be reinforced by metal rods 38 or other reinforcements to enable the socket 22 to better withstand the forces generated on those portions of the socket sidewall without failing when the socket 22 is used to tighten or loosen a complementary part.

Preferably, the second end portion 34 of the first tubular socket 22 contains four drive holes 40, e.g. holes with circular cross sections, for receiving a handle or rod 42 to drive or turn the first tubular socket to tighten or loosen a complementary part received within the notches 36. The drive holes 40 pass radially through the sidewall 30 and are spaced from each other on 90° centers creating two pairs of diametrically opposed holes for receiving a handle or rod 42 that can be inserted completely through the first tubular socket 22. Preferably, the second end portion of the first tubular socket 22 also has an end wall 44 with a drive hole 46, e.g. a hole with a square cross section, centrally located therein for receiving the drive of a conventional socket wrench, e.g. a quarter inch drive. Thus, either the drive holes 40 can be used with a handle or the drive hole 46 can be used with a conventional socket drive to turn or rotate the first tubular socket 22 and tighten or loosen complementary parts received within the notches 36 of the first tubular socket 22. While a drive hole 46 for receiving a conventional socket drive is preferred, rather than the drive hole 46, the end wall 44 could be provided with a centrally located square head for receiving a conventional socket drive.

Typical dimensions for a first tubular socket 22 used to tighten or loosen complementary parts for 1½ inch nominal diameter rigid plastic pipe are as follows: overall length about 4½ inches; internal diameter about 1⅛ inches; outside diameter about 1⅜ inches; sidewall (30) about ⅛ of an inch in thickness; notches (36) about ⅝ of an inch in depth, about ⅜ of an inch in width, and when used about 3⁄16 of an inch radius at their base; steel rods (38) 1⁄16 inch ×⅝ inch; drive holes (40) about 5⁄16 of an inch in diameter and spaced inward about 1 inch from the second end of the tubular socket 22; end wall (44) about ½ of an inch thick; and socket drive hole (46) about ¼ inch square.

As shown in FIGS. 4–6, the second tubular socket 24 has a tubular wall 60 with a first end portion 62 and a second end portion 64. The tubular wall 60 at the first end portion 62 has four notches 66 therein, which extend inward from the first end of the second tubular socket 24, parallel to the longitudinal axis 26, and are spaced from each other about the circumference of the tubular socket on 90° centers, for receiving a complementary part to be tightened or loosened. As shown in FIG. 5, the cut outs forming the notches 66 have a radius at their base. However, the notches 66 can also be squared off at their base. Typically, the notches 66 are squared off at their base when the second tubular socket is made of a metal e.g. steel and the notches have a radius at their base when the first tubular socket is made of plastic, e.g. a C polyvinyl chloride. While not shown, when the second tubular socket 22 is made of plastic, the portions of the socket sidewall 60 intermediate the notches 66 may be reinforced by metal rods or other reinforcements, in a manner similar to the rods 38 used to reinforce the socket sidewall 30 of the first tubular socket 22, to enable the socket 24 to better withstand the forces generated on those portions of the socket sidewall without failing when the socket 24 is used to tighten or loosen a complementary part. The internal and external diameters of the second tubular socket 24, at the first end portion 62 of the second tubular socket, are greater than the corresponding internal and external diameters at the first end portion 32 of the first tubular socket 22 so that the second tubular socket 24 can be used to rotate and tighten or loosen complementary parts for nominal pipe sizes greater than the nominal pipe size with which the first tubular socket 22 is used.

The second end portion 64 of the second tubular socket 24, has an internal diameter substantially equal to but slightly greater than the external diameter of the first end portion 32 of the first tubular socket 22 so that the second end portion 64 of the second tubular socket 24 can be slid over and form a close fit with the first end portion 32 of the first tubular socket 22 to removably mount the second tubular socket 24 on the first tubular socket 22. The interior surface of the tubular sidewall 60 of the second end portion 64 of the second tubular socket 24 is also provided with four ribs 68 which extend inward from the interior surface of the tubular sidewall 60 and are spaced from each other about the internal circumference of second tubular socket on 90° centers. The ribs 68 extend, parallel to the longitudinal axis 26, from a internal collar 70 on the interior surface of the tubular sidewall 60, located intermediate the first and second end portions of the second tubular socket 24, toward the second end of the second tubular socket 24. The ribs 68 have dimensions which enable the ribs 68 to be slid into, slid out of, and form a close fit with the notches 36 of the first tubular socket 22 so that, when the second tubular socket 24 is mounted on the first tubular socket 22 and the first tubular socket 22 is rotated, the second tubular socket 24 rotates with the first tubular socket 22.

Typical dimensions for a second tubular socket 24 used to tighten or loosen complementary parts for 2 inch nominal diameter rigid plastic pipe are as follows: overall length about 2⅜ inches; internal diameter at the first and second end portions (62 and 64) about 1⅜ inches; internal diameter of the collar (70) about 1⅛ inches; outside diameter about 1⅝ inches; sidewall (60) ⅛ of an inch in thickness at the first and second end portions (62 and 64) and about ¼ of an inch at the collar (70); notches (66) about 11/16 of an inch in depth, 7/16 of an inch in width, and when used, 7/32 of an inch radius at their base; collar (70) about ¼ of an inch wide, about 1⅜ inches from the first end, and about ¾ of an inch from the second end; ribs (68) about 5/16 of an inch wide, about ⅛ of an inch thick, about 7/16 of an inch long.

When the multi-purpose plumbing tool 20 of the present invention is used to rotate and tighten or loosen a pipe fitting plug 80 , the four corners 82 of the head 84 of the plug 80 are received within the four notches 36 or 66. When the multi-purpose plumbing tool 20 of the present invention is used to rotate and tighten or loosen a flanged faucet nut 86 or another part with flanges, such as but not limited to a flanged drain plug, the flanges 88 and 90 of the nut 86 are received within the diametrically opposed pairs of the four notches 36 or 66. Of course, if the flanged faucet nut 86 or other part only had a pair of flanges, e.g. either flanges 88 or 90, the pair of flanges would be received in a pair of the four notches 36 or 66 which are diametrically opposed. When the multi-purpose plumbing tool 20 of the present invention is used to rotate and tighten or loosen a bathtub drain piece 92 or a similar part, such as but not limited to a sink basket strainer, the four spokes 94 at the bottom of the bathtub drain piece are received within the four notches 36 or 66.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A multi-purpose plumbing tool assembly, comprising:

a first tubular socket; the first tubular socket having a tubular wall, a first end portion and a second end portion; the tubular wall at the first end portion of the first tubular socket having four notches therein, extending inward from a first end of the first tubular socket and spaced from each other on 90° centers, for receiving complementary parts to be rotated and tightened or loosened that are used with 1½ inch nominal diameter pipe; and the second end portion having means for rotating the first tubular socket to tighten or loosen a complementary part received in the notches; and a second tubular socket; the second tubular socket having a tubular wall, a first end portion and a second end portion; the tubular wall at the first end portion of the second tubular socket having four notches therein, extending inward from a first end of the second tubular socket and spaced from each other on 90° centers, for receiving complementary parts to be rotated tightened or loosened that are used with 2 inch nominal diameter pipe; and the second end portion of the second tubular socket having rib means on the interior surface of the second end portion of the second tubular socket which are slidably received within the notches of the first tubular socket for removably mounting the second tubular socket on the first end portion of the first tubular socket to rotate with the first tubular socket so that the means for rotating the first tubular socket to tighten or loosen a complementary part received in the notches of the first tubular socket can also be used to rotate the second tubular socket, when mounted on the first tubular socket, to tighten or loosen a complementary part received in the notches of the second tubular socket.

2. The multi-purpose plumbing tool according to claim 1, wherein:

each notch is a cut out.

3. The multi-purpose plumbing tool according to claim 1, wherein:

the means for rotating the first tubular socket to tighten or loosen a complementary part received in the notches comprises at least one hole in the tubular wall at the second end portion of the first tubular socket for receiving a handle.

4. The multi-purpose plumbing tool according to claim 1, wherein:

the second end portion of the first tubular socket has an end wall; and the means for rotating the first tubular socket to tighten or loosen a complementary part received in the notches comprises a hole in the end wall at the second end portion of the first tubular socket for receiving a conventional socket drive.

5. The multi-purpose plumbing tool according to claim 1, wherein:

the second end portion of the first tubular socket has an end wall; and the means for rotating the first tubular socket to tighten or loosen a complementary part received in the notches comprises a hole in the end wall at the second end portion of the first tubular socket for receiving a conventional drive and at least one hole in the tubular wall at the second end portion of the first tubular socket for receiving a handle.

* * * * *